US007020957B2

(12) United States Patent
Johnson

(10) Patent No.: US 7,020,957 B2
(45) Date of Patent: Apr. 4, 2006

(54) METHODS AND APPARATUS FOR HIGH PERFORMANCE ELECTRICAL CONNECTIONS

(75) Inventor: Morgan T. Johnson, Portland, OR (US)

(73) Assignee: Morgan Connector, Hillsboro, OR (US)

( * ) Notice: Subject to any disclaimer, the term of this patent is extended or adjusted under 35 U.S.C. 154(b) by 0 days.

(21) Appl. No.: 10/789,287

(22) Filed: Feb. 27, 2004

(65) Prior Publication Data

US 2004/0168318 A1 Sep. 2, 2004

Related U.S. Application Data

(60) Provisional application No. 60/451,112, filed on Feb. 27, 2003, provisional application No. 60/450,844, filed on Feb. 28, 2003.

(51) Int. Cl.
*H01R 9/00* (2006.01)

(52) U.S. Cl. ..... 29/845; 29/825; 29/830; 29/846; 29/852; 174/88 C; 174/88 R; 174/95

(58) Field of Classification Search ..... 29/828, 29/825, 857, 867, 830, 845, 846, 852; 174/88 C, 174/88 R, 95, 97, 101
See application file for complete search history.

(56) References Cited

U.S. PATENT DOCUMENTS

| | | | | |
|---|---|---|---|---|
| 4,201,433 | A * | 5/1980 | Caldwell | 439/98 |
| 4,653,840 | A * | 3/1987 | Grabbe et al. | 439/578 |
| 4,935,584 | A * | 6/1990 | Boggs | 174/262 |
| 5,281,762 | A * | 1/1994 | Long et al. | 174/78 |
| 5,384,955 | A * | 1/1995 | Booth et al. | 29/830 |
| 5,386,627 | A * | 2/1995 | Booth et al. | 29/852 |
| 6,031,185 | A * | 2/2000 | Bouveret et al. | 174/84 R |

* cited by examiner

*Primary Examiner*—Carl J. Arbes
(74) *Attorney, Agent, or Firm*—Werner & Axenfeld, PC

(57) ABSTRACT

Coax and twinax connector assemblies, suitable for low-cost manufacturing and high-frequency performance, include one or more slices of insulating material having a series of through-holes therein. Dimensions of the through-holes are tailored to the dimensions of the coax or twinax that are to be fitted to such connector assemblies. The slices may have dimensions that are uniform to within typical manufacturing tolerances. By combining, or stacking, the slices, the connector height can be customized to a particular application. A variety of slice thicknesses are provided so that a variety of final connector heights may be achieved. Conductive material sheets may be disposed between one or more pairs of connector slices so as to provide a common ground connection for one or more conductors, such as, for example, ground shields, disposed in the through-holes of the stacked connector slices. Additionally, right angle connectors and low-cost twinax cables are disclosed.

12 Claims, 24 Drawing Sheets

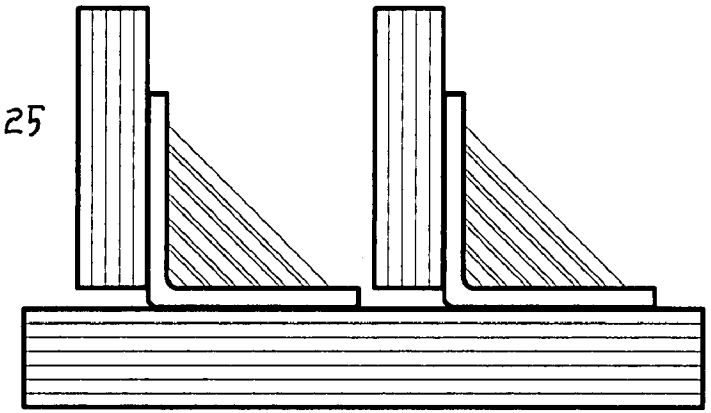
Fig 25
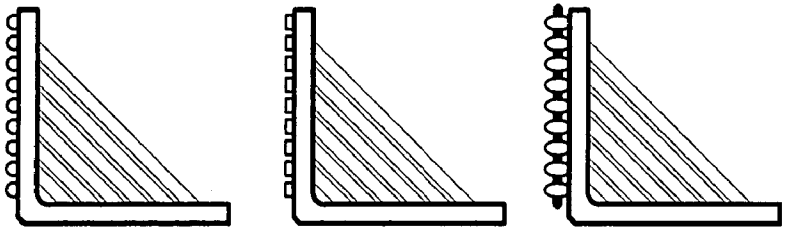
Fig. 27
Fig. 28
Fig. 29
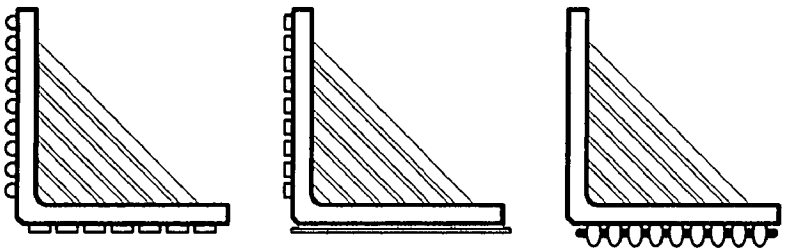
Fig. 30
Fig. 31
Fig. 32

METHODS AND APPARATUS FOR HIGH PERFORMANCE ELECTRICAL CONNECTIONS

This non-provisional patent application claims the benefit of earlier filed co-pending provisional application 60/451,112, filed 27 Feb. 2003; and 60/450,844, filed 28 Feb. 2003.

FIELD OF THE INVENTION

The present invention relates generally to methods and apparatus for providing electrical connections.

BACKGROUND

Advances in semiconductor manufacturing technology and digital systems architecture have led to the development of electronic systems that operate at ever higher frequencies. Such high frequency operation increases the importance of reducing or eliminating impedance mismatches when connecting two or more electrical components, or devices. Connections between components, printed circuit boards, and systems, is conventionally accomplished by means of connectors. Unfortunately, conventional connectors tend to introduce undesirable impedance mismatches.

Coaxial cable, or coax, has traditionally been used in many high frequency systems for signal transmission. Conventional connectors that have been used to attach coax to signal sources and destinations, generally have an adverse effect on the integrity of the signal transmitted through those connectors. Conventional connectors may introduce impedance mismatches which degrade signal integrity, or quality. The result of such signal degradation is a reduction in the frequency operating range for the systems in which such conventional coax connectors are used.

Another approach to high frequency signal transmission is the twin-axial cable, or twinax. Twinax, by including two signal conductors surrounded by dielectric and a common ground shield, provides a means to employ low voltage differential signalling. Conventional connectors for twinax, like those for coax, degrade the integrity, or quality, of the signals transmitted through such conventional twinax connectors. The result of such signal degradation is a reduction in the frequency operating range for the systems in which such conventional twinax connectors are used.

Regardless of whether coax or twinax is used to transmit signals in a system, both such conductors are often required to connect components physically located on different printed circuit boards. In some circumstances, these printed circuit boards are arranged such that they are perpendicular to each other. These perpendicular arrangements of circuit boards may be found in personal computers and similar electronic systems. Such perpendicularly oriented circuit boards are sometimes referred to as daughter cards. To connect these boards, the coax or twinax are conventionally fitted with connectors at either end of a cable segment, and the cable bent through a predetermined radius of curvature so that a connection may be made between the two circuit boards. As noted above, such a connection architecture degrades the signal quality, and thereby the speed at which such an electronic system may operate.

Additionally, it is well known that electronic systems with high frequency operation are now common in consumer electronic products. Consumer electronics is one segment of the electronics market that is particularly sensitive to the costs of the component parts used to construct such products.

What is needed are methods and apparatus for improving the electrical performance of connectors in high frequency systems, and lowering the cost of such connectors as compared to conventional connectors.

SUMMARY OF THE INVENTION

Briefly, coax and twinax connector assemblies, suitable for low-cost manufacturing and excellent high-frequency performance, include one or more slices of an insulating material having a series of through-holes formed therein. The dimensions of the through-holes are tailored to the dimensions of the coax or twinax that are to be fitted to such connector assemblies. The slices are preferably formed to have dimensions that are uniform to within typical manufacturing tolerances. By combining, or stacking, the uniform dimension slices, the connector height can be customized to a particular application. In a further aspect of the present invention a variety of slice thicknesses are provided so that a wide variety of final connector heights may be achieved through combining an appropriate number of slices of the different thicknesses.

In a still further aspect of the present invention, conductive material sheets may be disposed between one or more pairs of connector slices so as to provide a common ground connection for one or more conductors, such as, for example, ground shields, disposed in the through-holes of the stacked connector slices.

In a particular class, or family, of connector structures, connections between perpendicularly oriented connection points is provided. Such a family of connectors may be referred to right angle connectors.

In a further aspect of the present invention, a low-cost, high-performance twinax conductor arrangement is provided.

BRIEF DESCRIPTION OF THE DRAWINGS

FIG. 20 illustrates how the conductors disposed in the through-holes of the connector slices of FIG. 19 form connections to a sheet of conductive bumps.

FIG. 25 is a side view of a printed circuit board having two perpendicularly oriented daughter cards that are electrically and mechanically connected to the printed circuit board by right angle connectors in accordance with the present invention.

FIG. 27 is a cross-sectional view of a right angle connector having solder balls disposed on an outer side of one vertical wall portion.

FIG. 28 is a cross-sectional view of a right angle connector having screened conductive elastomer disposed on an outer side of one vertical wall portion.

FIG. 29 is a cross-sectional view of a right angle connector having conductive bumps disposed on an outer side of one vertical wall portion.

FIG. 30 is a cross-sectional view of a right angle connector having screened conductive elastomer disposed on an outer side of one horizontal wall portion.

FIG. 31 is a cross-sectional view of a right angle connector having anisotropic sheet stock disposed on an outer side of one horizontal wall portion.

FIG. 32 is a cross-sectional view of a right angle connector having conductive bumps disposed on an outer side of one horizontal wall portion.

DETAILED DESCRIPTION

Figures 1, 2, 3, 4, 5, 6, 7, 8:
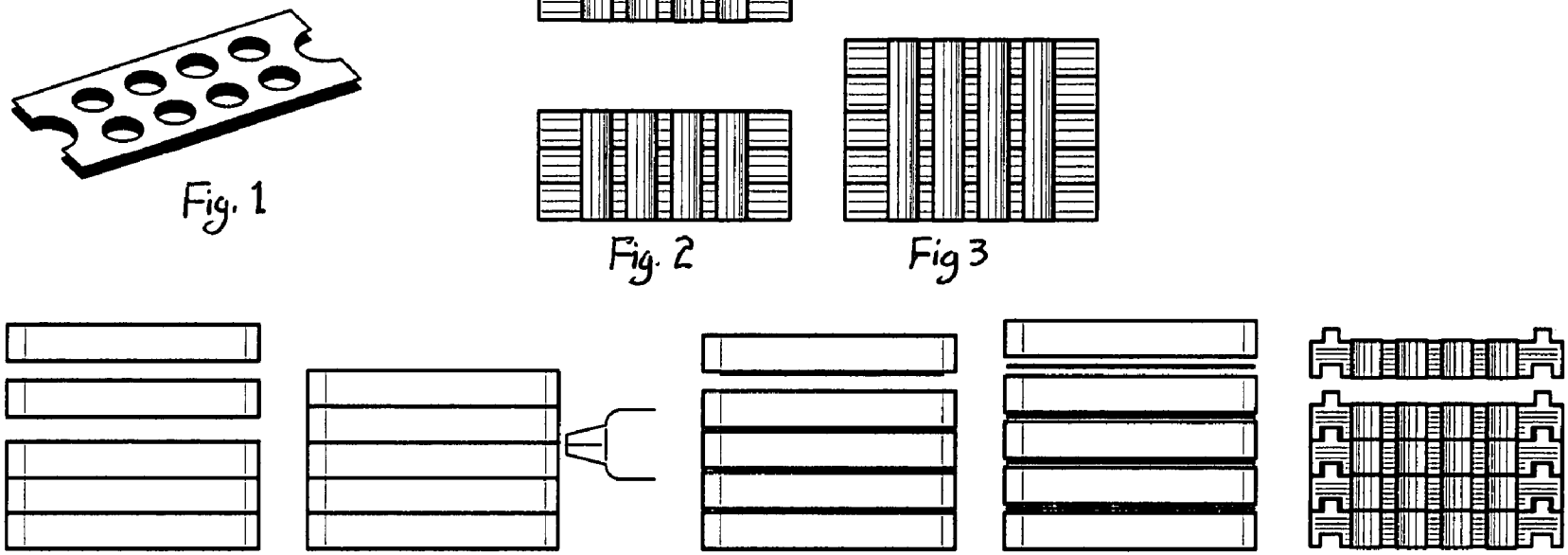
FIG. 1 is an isometric view of a connector slice having coax compatible through-holes in accordance with the present invention.
FIG. 2 is a cross-sectional view of a three-high stack of slices with conductors fitted into the through-holes, with the conductors cut to be substantially coplanar with the upper and lower surfaces of the three-high stack.
FIG. 3 is a cross-sectional view of a five-high stack of slices with conductors fitted into the through-holes, with the conductors cut to be substantially coplanar with the upper and lower surfaces of the five-high stack.
FIG. 4 is a side view of a simple stack of slices.
FIG. 5 is a side view of a stack of slices disposed next to a low viscosity glue dispenser.
FIG. 6 is a side view of a stack of slices having an adhesive disposed on one surface thereof.
FIG. 7 is a side view of a stack of slices interleaved with adhesive sheets disposed therebetween.
FIG. 8 is a side view of a pair of slices that are adapted for snap together construction.

Generally, the present invention relates to electrical connector structures, and methods of making electrical connectors and electrical connections. More particularly, the present invention relates to methods and apparatus for high-performance, low-cost, electrical connections. Such connectors find application in electronic products and systems where both cost and high frequency performance are concerns.

Reference herein to "one embodiment", "an embodiment", or similar formulations, means that a particular feature, structure, operation, or characteristic described in connection with the embodiment, is included in at least one embodiment of the present invention. Thus, the appearances of such phrases or formulations herein are not necessarily all referring to the same embodiment. Furthermore, various particular features, structures, operations, or characteristics may be combined in any suitable manner in one or more embodiments.

TERMINOLOGY

The thickness of a conductive layer on printed circuit boards and similar substrates, is sometimes referred to in this field in terms of ounces (oz.). This is based on the weight of one square foot of a conductive layer of a particular material and thickness. For example, a thickness referred to as 0.5 oz. copper, is approximately 18 microns thick, because one square foot of copper, plated on a substrate to a thickness of 18 microns, weighs 0.5 oz. Similarly, a thickness referred to as 1.0 oz. copper, is approximately 36 microns thick, and so on.

The terms, chip, integrated circuit, monolithic device, semiconductor device, and microelectronic device, are often used interchangeably in this field. The present invention is applicable to all the above as they are generally understood in the field.

Contact pads refer to regions of conductive material, typically a metal, metal alloy, or stack structure including several layers of metals and/or metal alloys. Contact pads are terminals which provide for electrical connection to be made to an electrical node.

Generally, connectors provide a pathway between at least two connection points. Commonly, connectors are used to bring two electrical nodes into contact so as to form a single electrical node. It will be appreciated that, in addition to electrical connections, optical connections can also be made. Connectors provide for physically joining at least one signal source to at least one signal sink (i.e., destination).

With respect to electrical connectors, two areas of interest are: the mechanical aspects of making the connection; and the electrical characteristics of the connection.

In accordance with one aspect of the present invention, a series of connector slices is used to form the body of a connector. Such a connector may be referred to as a mezzanine connector. By stacking, or combining, a plurality of these slices, the height of the mezzanine connector may be adjusted. The slices may all be of the same thickness, or slices of differing thicknesses may be combined in order to obtain a finer granularity with respect to establishing the final height of the mezzanine connector. Various aspects of such mezzanine connectors are illustrated in FIGS. 1–24.

The slices, or segments, used in assembling the mezzanine connectors may be, but are not limited to, injection molded plastic shapes, or machined plastic parts. The slices may be formed of the same material (e.g., FR4) as is used to make printed circuit boards, and may even be made by drilling the through-holes, and sawing apart the slices from a blank circuit board. The materials used to form such slices are generally electrically insulating. The slices, in one embodiment of the present invention, have through-holes that are adapted to receive coax. Through-holes for receiving coax are generally circular in form. Alternatively, the slices may have through-holes that are adapted to receive twinax. Through-holes for receiving twinax are generally oval in form. It will be appreciated that bare wire, coax, twinax, or similar constructions may be disposed in the through-holes of a mezzanine connector of the present invention. Slices may be formed that have through-holes to accommodate twinax; coax; power and ground; and low-speed wiring; or any similar combination (as can be seen in FIGS. 14–22). Further, the slices may have cut-outs (FIGS. 21–22) that accommodate structural features of the circuit boards to which a connector formed of the slices is mated.

Figure 23:
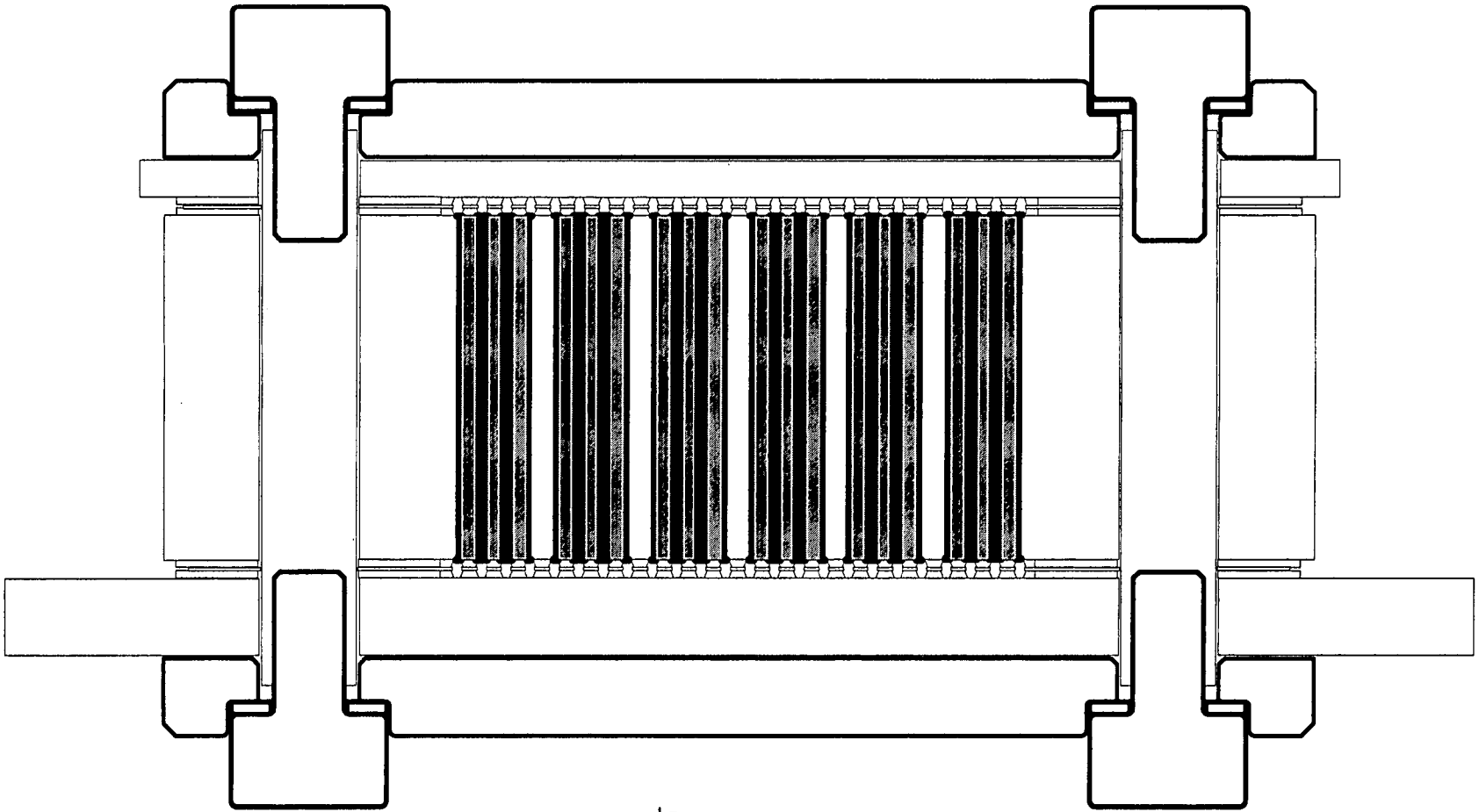
FIG. 23 is a cross-sectional view of a connector in accordance with the present invention wherein the connector slices are held in position by top and bottom clamping, or pressure, plates and threaded screws.
Figure 24:
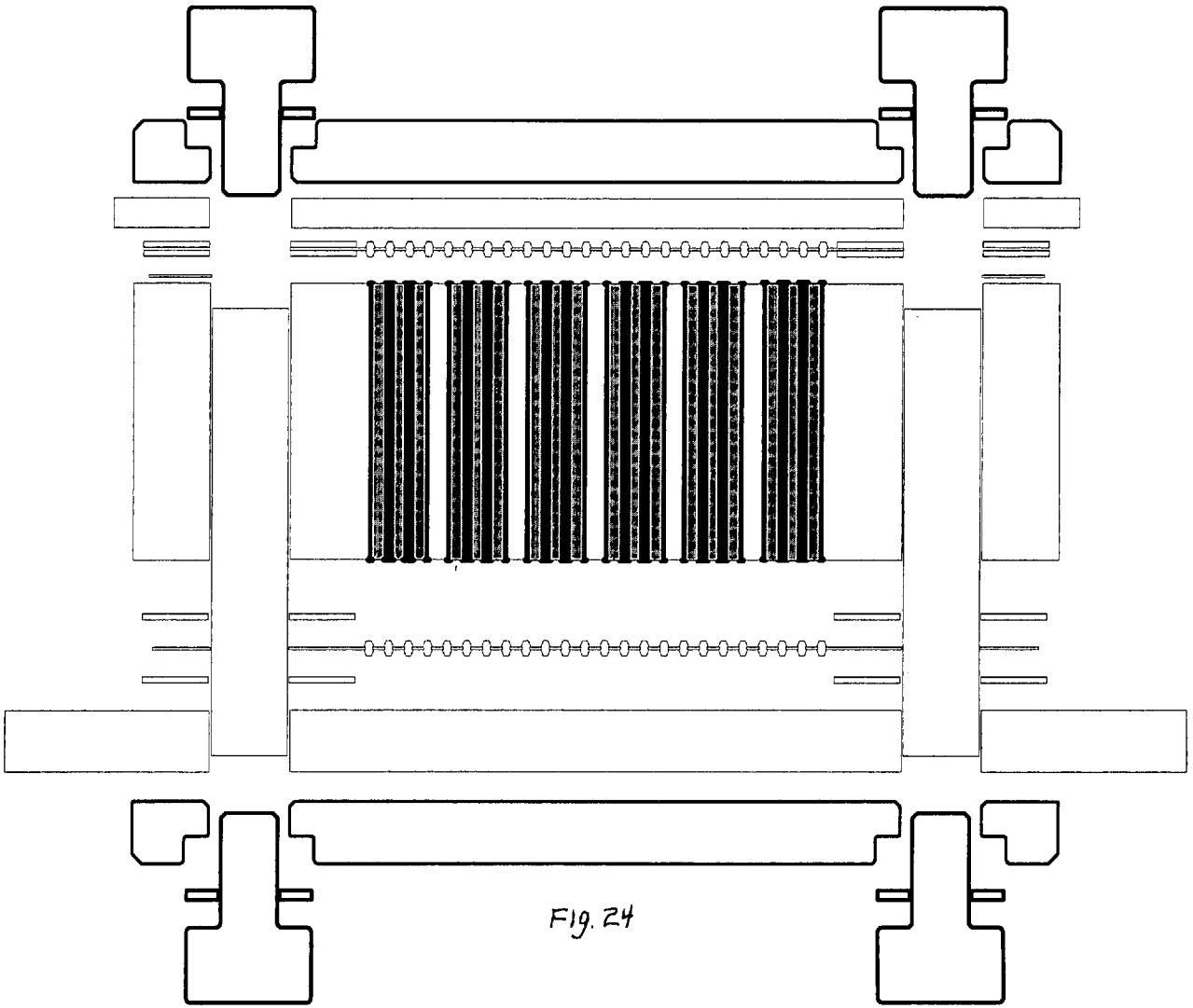
FIG. 24 is an exploded cross-sectional view of the connector of FIG. 23.
Figure 26:
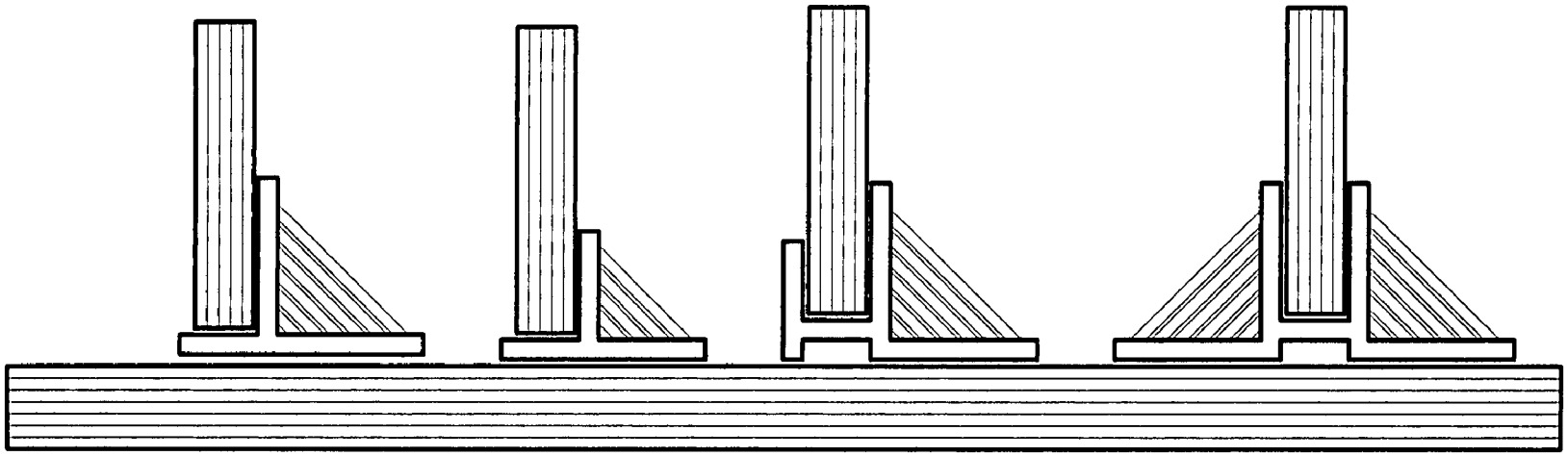
FIG. 26 is similar to FIG. 25 but shows alternative mechanical configurations for connecting the daughter cards to the printed circuit board.
Figure 33:
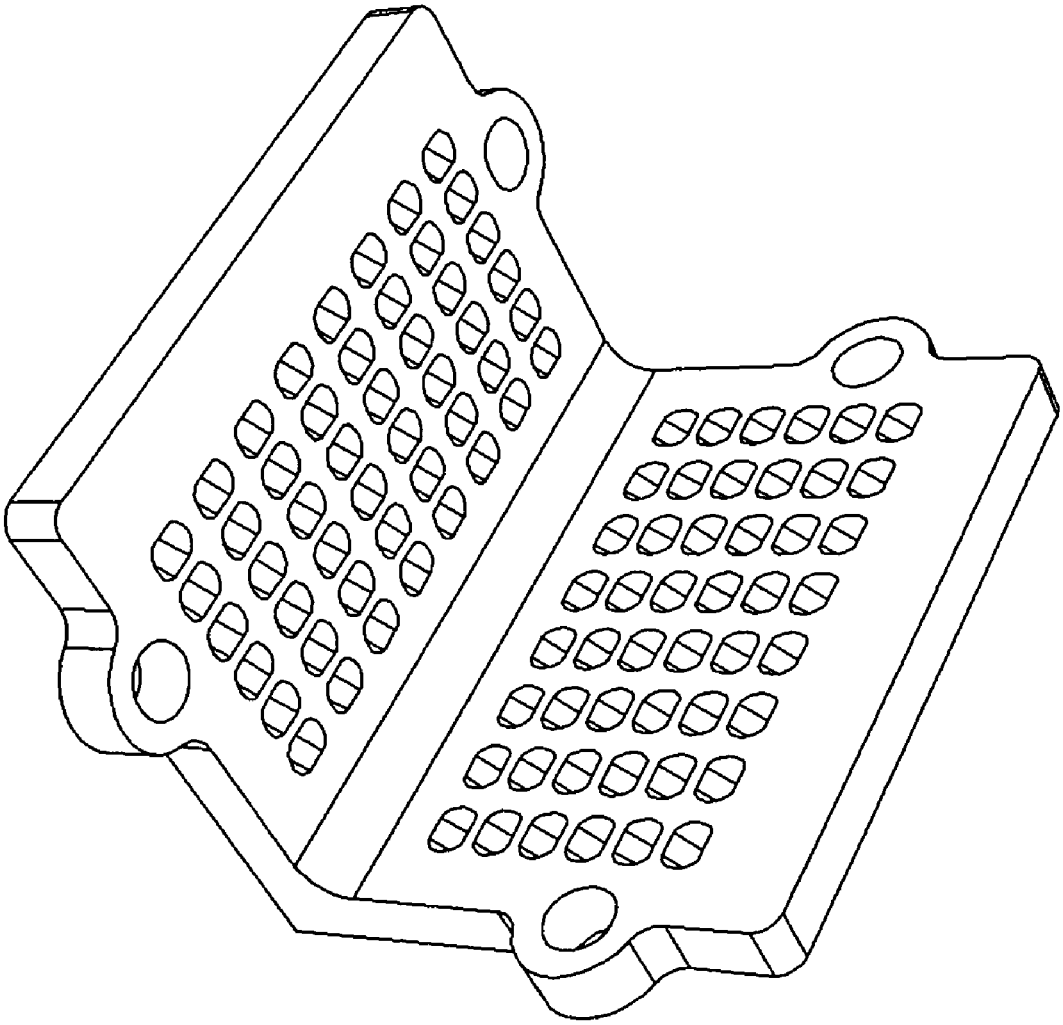
FIG. 33 illustrates a right angle connector frame in accordance with the present invention prior to disposing conductors such as twinax or coax into and between the through-holes.
Figure 35:
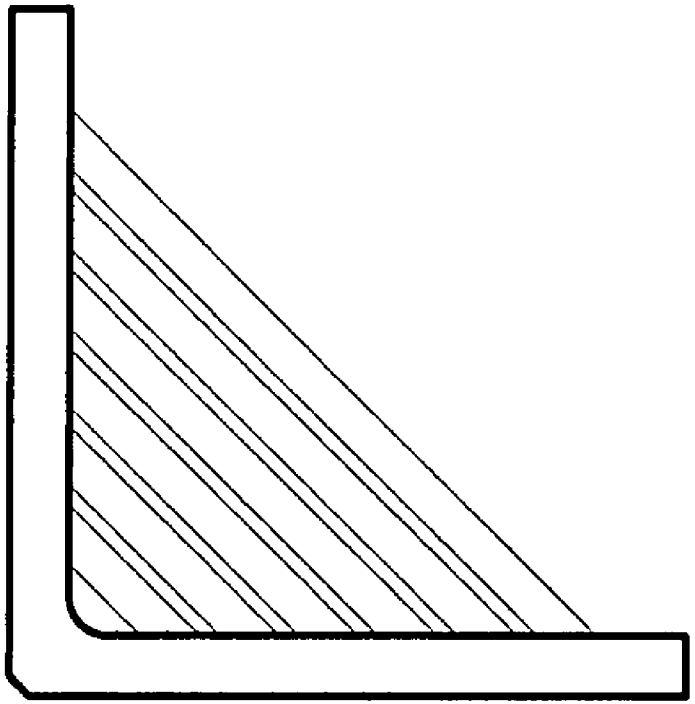
FIG. 35 is a side view of a right angle connector with conductors, such as coax or twinax cable segments, disposed between and through the through-holes of the right angle connector frame.
Figure 34:
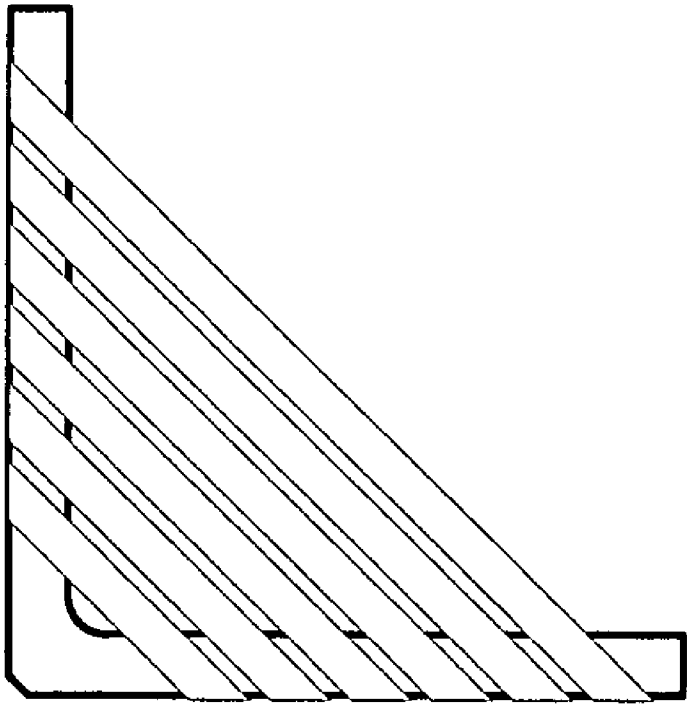
FIG. 34 is a cross-sectional view of a right angle connector with conductors, such as coax cable segments, disposed between and through the through-holes of the right angle connector frame.
Figure 36:
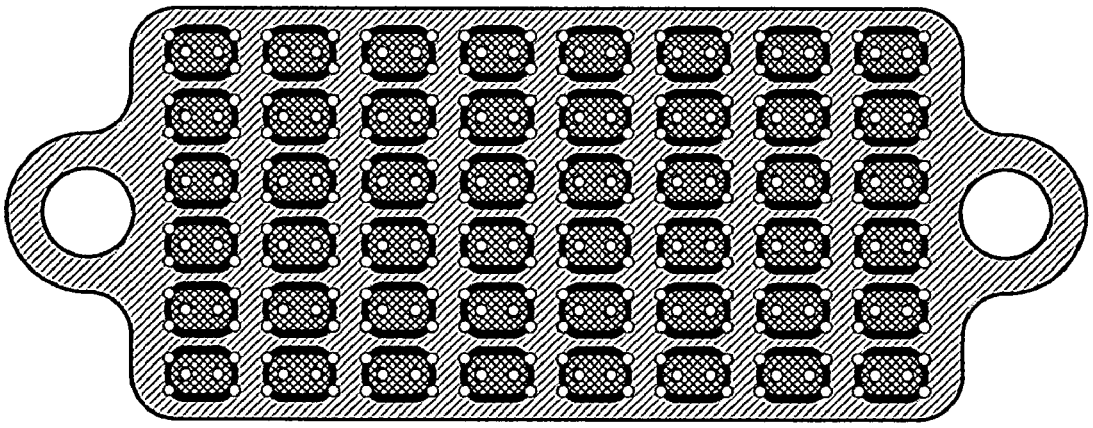
FIG. 36 illustrates an outer surface of a right angle connector frame with twin ax conductors installed in the through-holes, and a one millimeter pattern of conductive bumps disposed so as to make electrical contact with the twinax ground shield.
Figure 37:
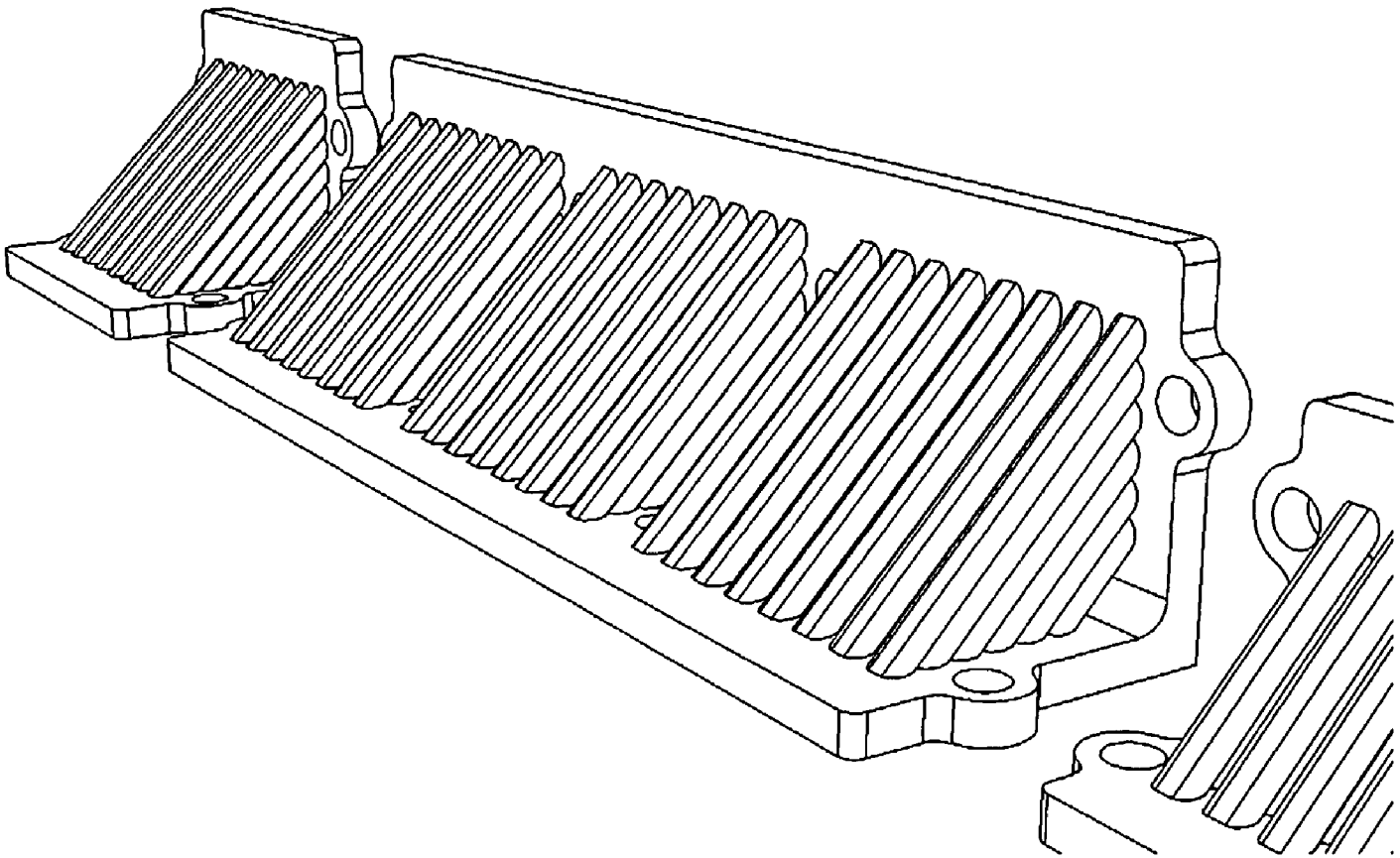
FIG. 37 shows examples of fully assembled right angle connectors, the conductors being disposed at an angle of approximately 45 degrees.

The connector slices in a stack which forms a connector may be simply stacked (FIG. 4). Opposing pressure plates may be used to hold a stack together (FIG. 23). Alternatively, the slices in a stack which forms a connector may be attached by any suitable means, including various adhesives. The slices may be bonded or glued subsequent to assembly. For example, a low viscosity glue may be applied to outer portions of the stack (FIG. 5). In other embodiments an adhesive may be pre-applied to one side of the slice (FIG. 6). In still other embodiments adhesive sheets may be inserted between slices (FIG. 7). In still other embodiments the slices may be formed so as to snap together (FIG. 8).

Figure 12:
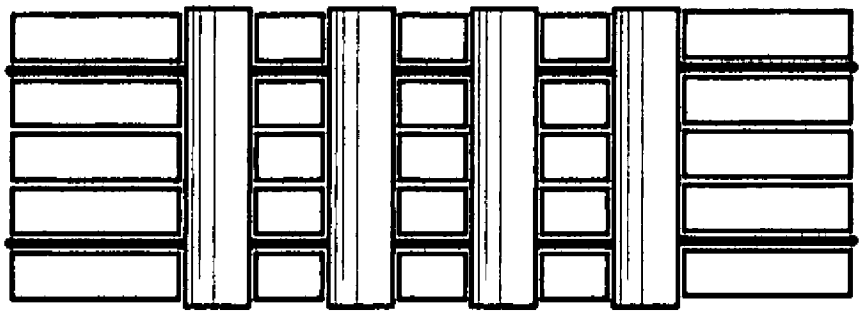
FIG. 12 is a cross-sectional view of a connector including a stack of connector slices, and conductive layers disposed between at least a portion of the pairs of stacked connector slices, the conductive layers configured to make electrical contact with at least a portion of the conductive pathways formed in the coaxially aligned through-holes of the stacked connector slices.

With regard to coax or twinax, these may be disposed in the through-holes of the body of a connector in accordance with the invention either with or without an outer insulating jacket. In some embodiments, the coax or twinax is disposed in the through-holes without and insulating jacket, and therefore the ground shield is exposed. Some embodiments provide for one or more layers of electrically conductive material to be disposed between the slices which form the body of a mezzanine connector. In this way, electrical contact can be made to the ground shield at various points along its path through the connector (FIG. 12). In other words, conductive layers may be inserted between the slices so as to provide connections to the ground shield of coax or twinax cables.

Figure 10:
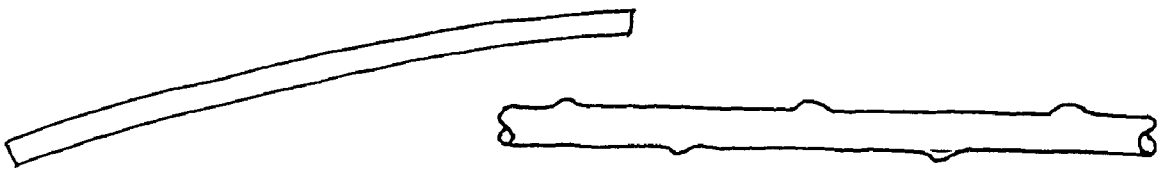
FIG. 10 is a side view of a conductor having a slight bend, or curvature, such that when inserted into the aligned through-holes of a stack of connector slices, the conductor remains in position.
Figure 9:
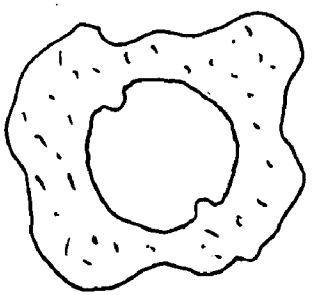
FIG. 9 is a top view of a through-hole incorporating a cavity interference feature to take up tolerances thereby holding an inserted element, such as a conductor, in place.
Figure 11:
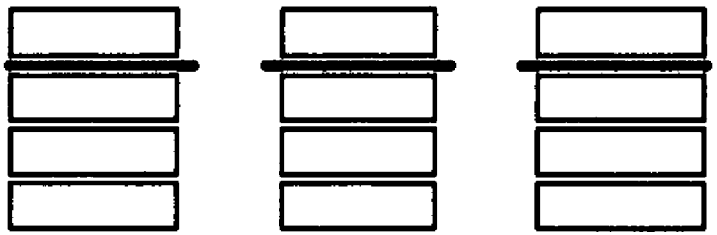
FIG. 11 is a side view of a plurality of stacked connector slices, each stack having a tight-sheet disposed between at least one pair of stacked connector slices.
Figure 13:
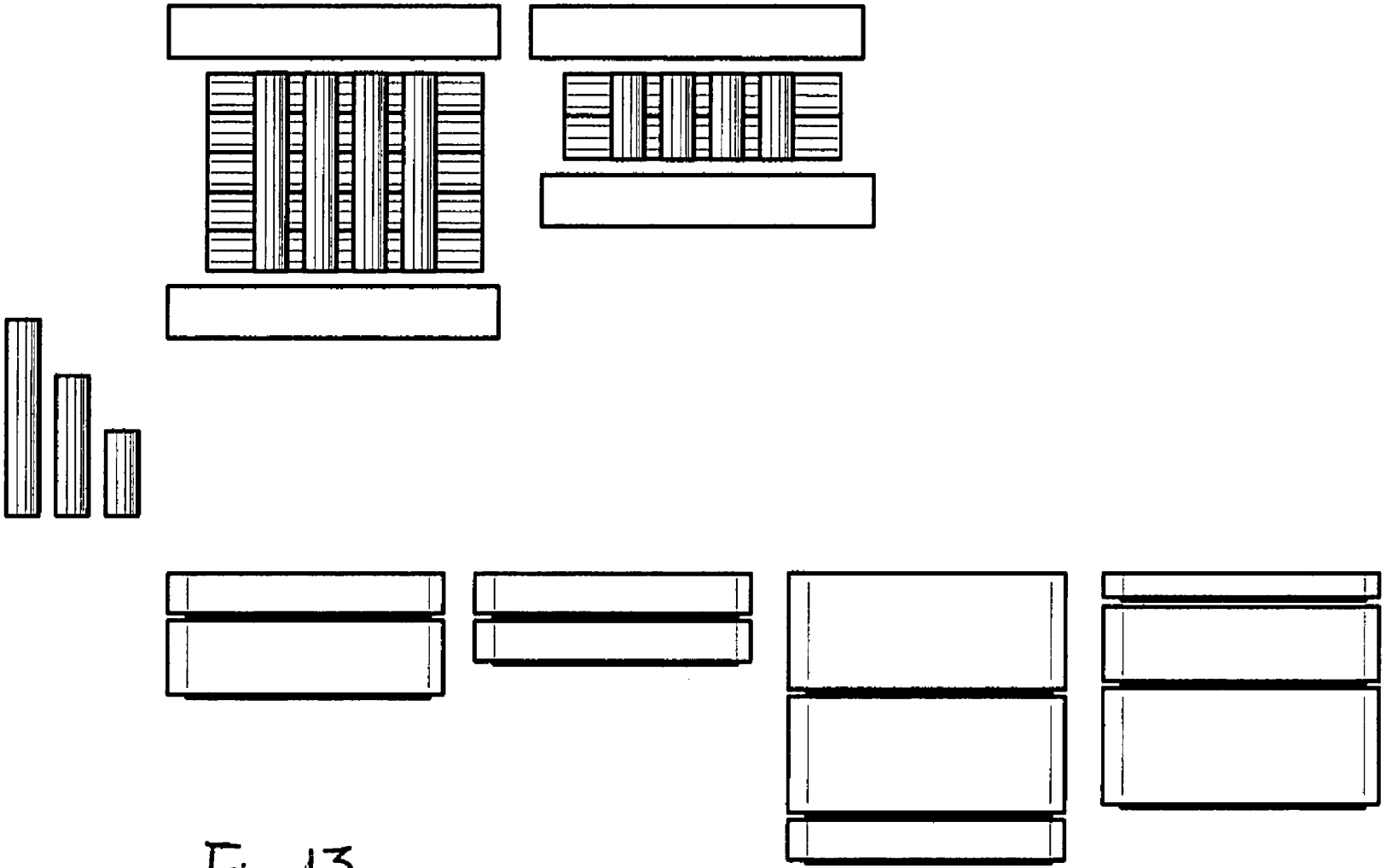
FIG. 13 is a cross-sectional view of a pair of connectors having different heights, the connectors being formed from a different number of connector slices.
Figure 14:
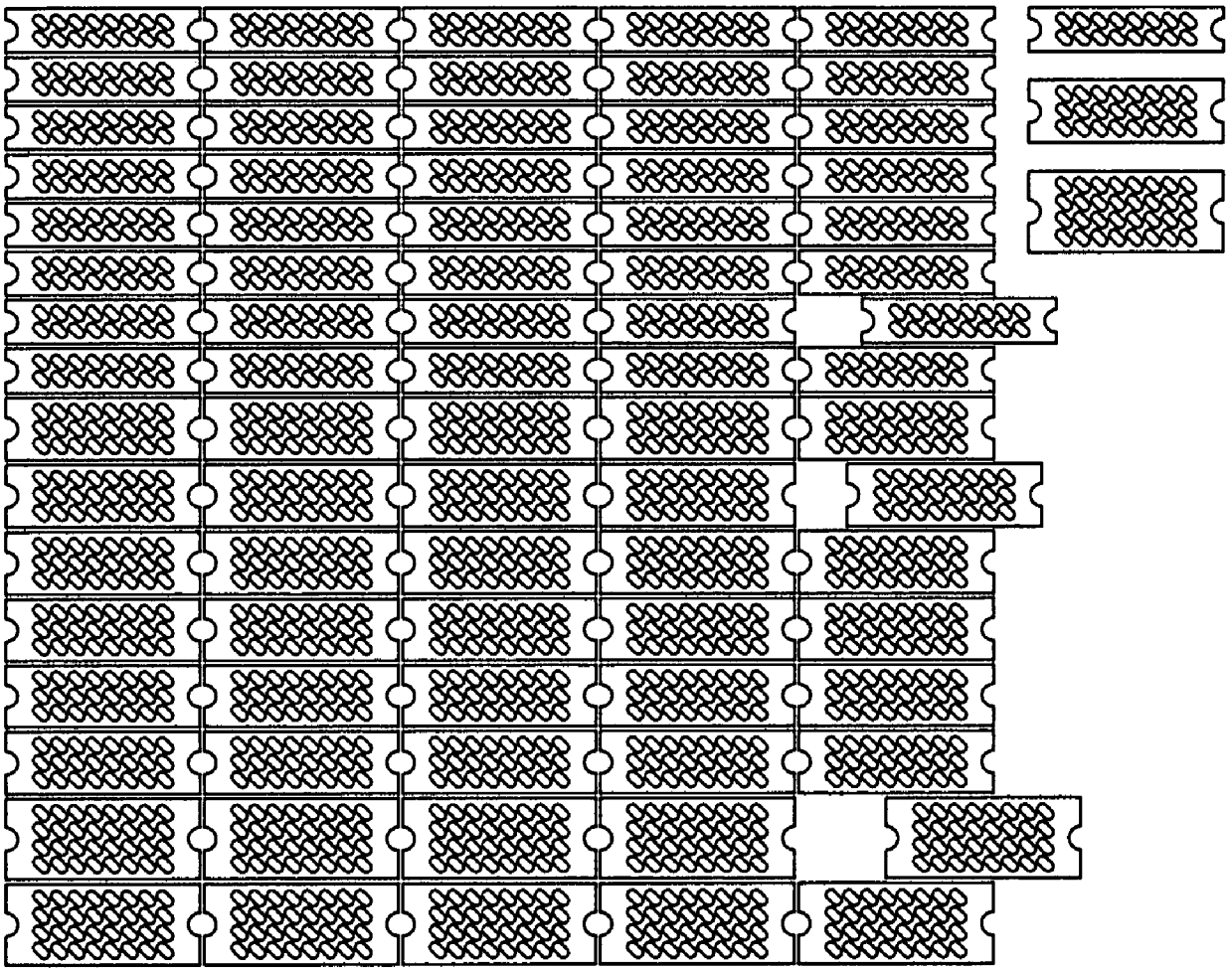
FIG. 14 is a top view of an two-dimensional array of connector slices, the connector slices each having twinax style through-holes, a first portion of the connector slices having two rows of twinax style through-holes, and a second portion of the connector slices having three rows of twinax style through-holes.
Figure 15:
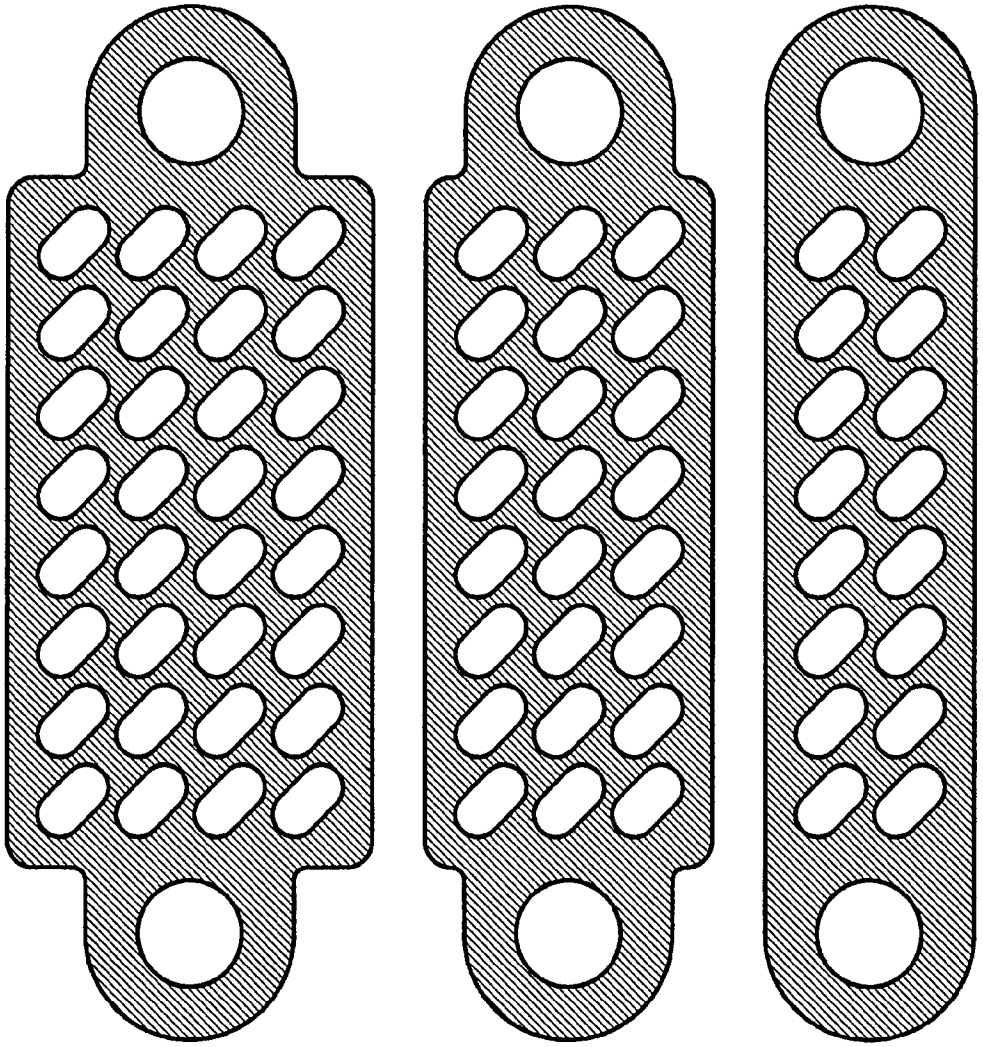
FIG. 15 is a top view of three connector slices disposed adjacently, a first connector slice having two rows of twinax-style through-holes, a second connector slice having three rows of twinax-style through-holes, and a third connector slice having four rows of twinax-style through-holes.
Figure 16:
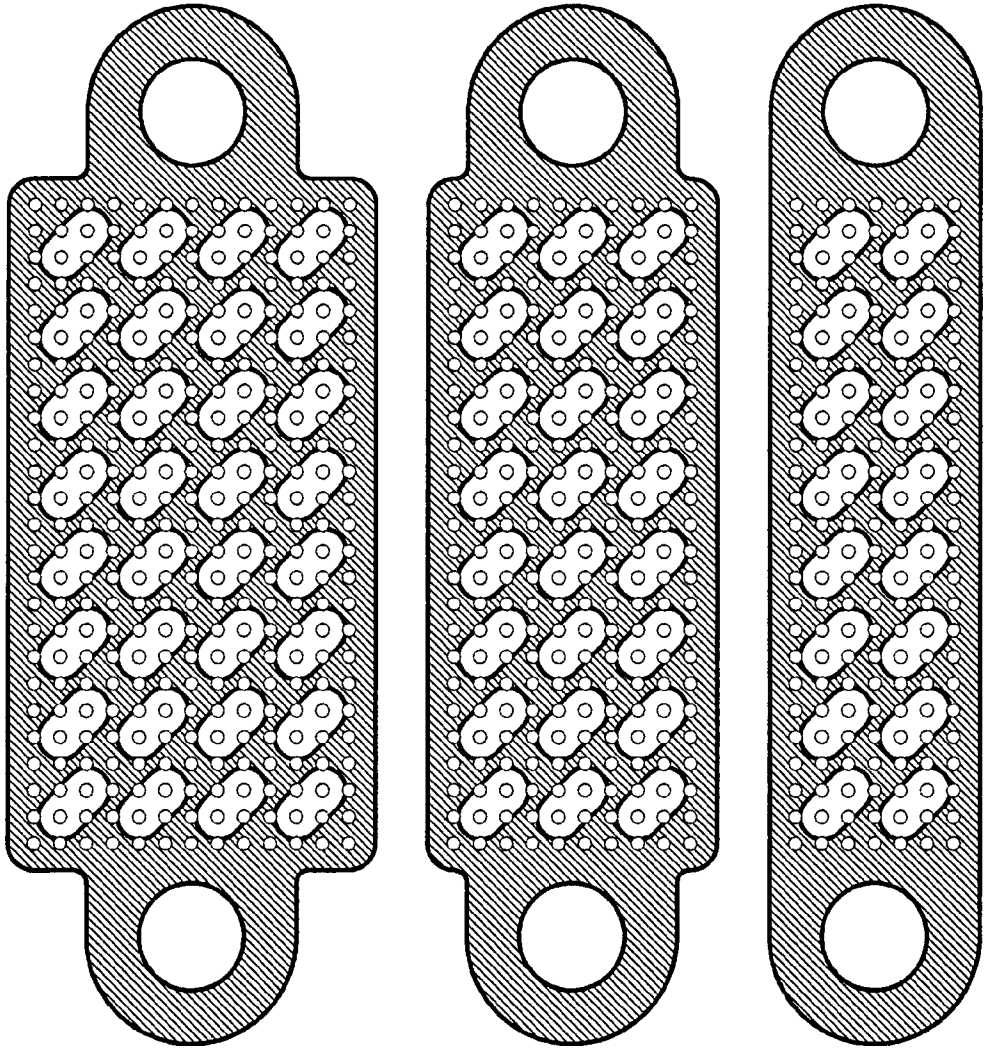
FIG. 16 illustrates how the conductors disposed in the through-holes of the connector slices of FIG. 15 form connections to a sheet of conductive bumps.
Figure 17:
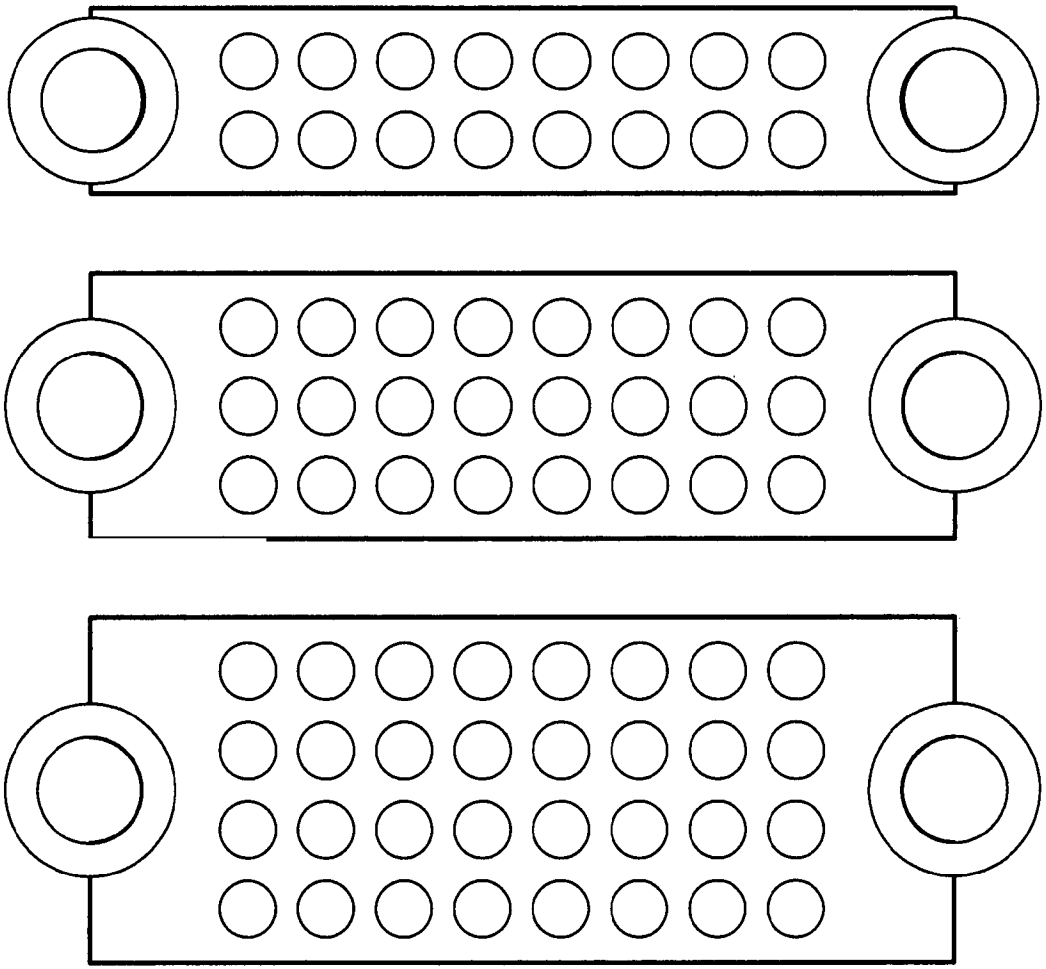
FIG. 17 is a top view of three connector slices disposed adjacently, a first connector slice having two rows of coax-style through-holes, a second connector slice having three rows of coax-style through-holes, and a third connector slice having four rows of coax-style through-holes.
Figure 18:
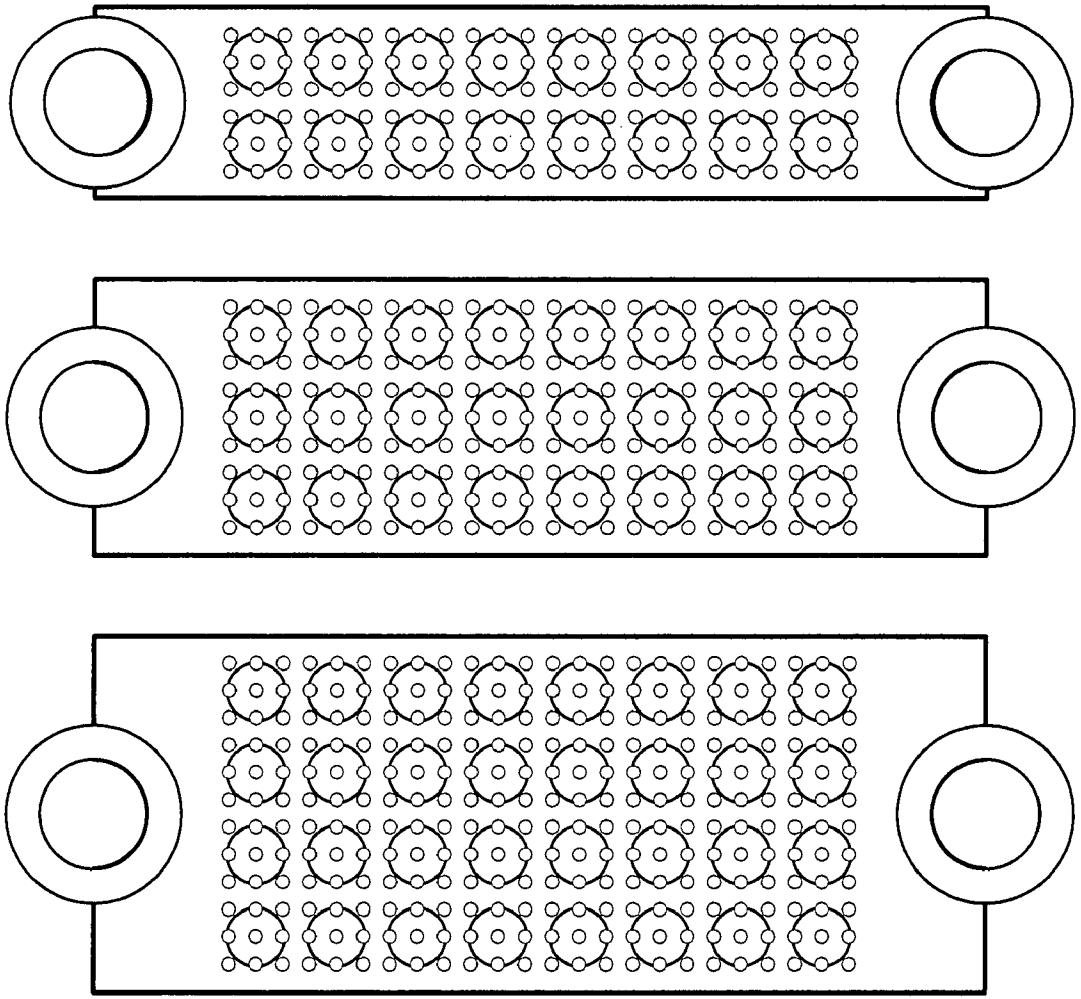
FIG. 18 illustrates how the conductors disposed in the through-holes of the connector slices of FIG. 17 form connections to a sheet of conductive bumps.
Figure 19:
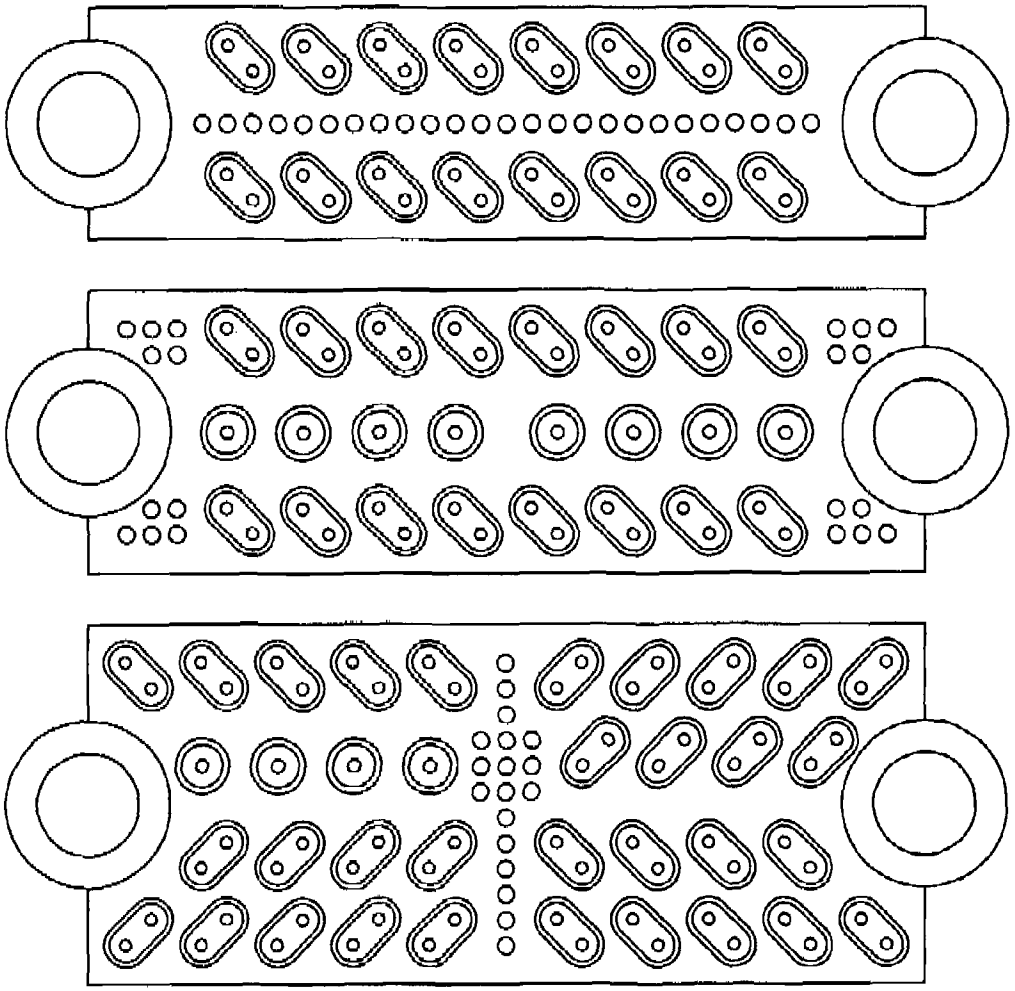
FIG. 19 is a top view of three connector slices disposed adjacently, a first connector slice having two rows of twinax-style through-holes and one row of single conductor through-holes, a second connector slice having two rows of twinax-style through-holes, one row of coax-style through-holes, and groups of single conductor through-holes disposed in corner regions of the second connector slice; and a third connector slice having four rows of twinax-style through-holes and a group of single conductor through-holes disposed in a central region of the third connector slice.
Figure 2D:
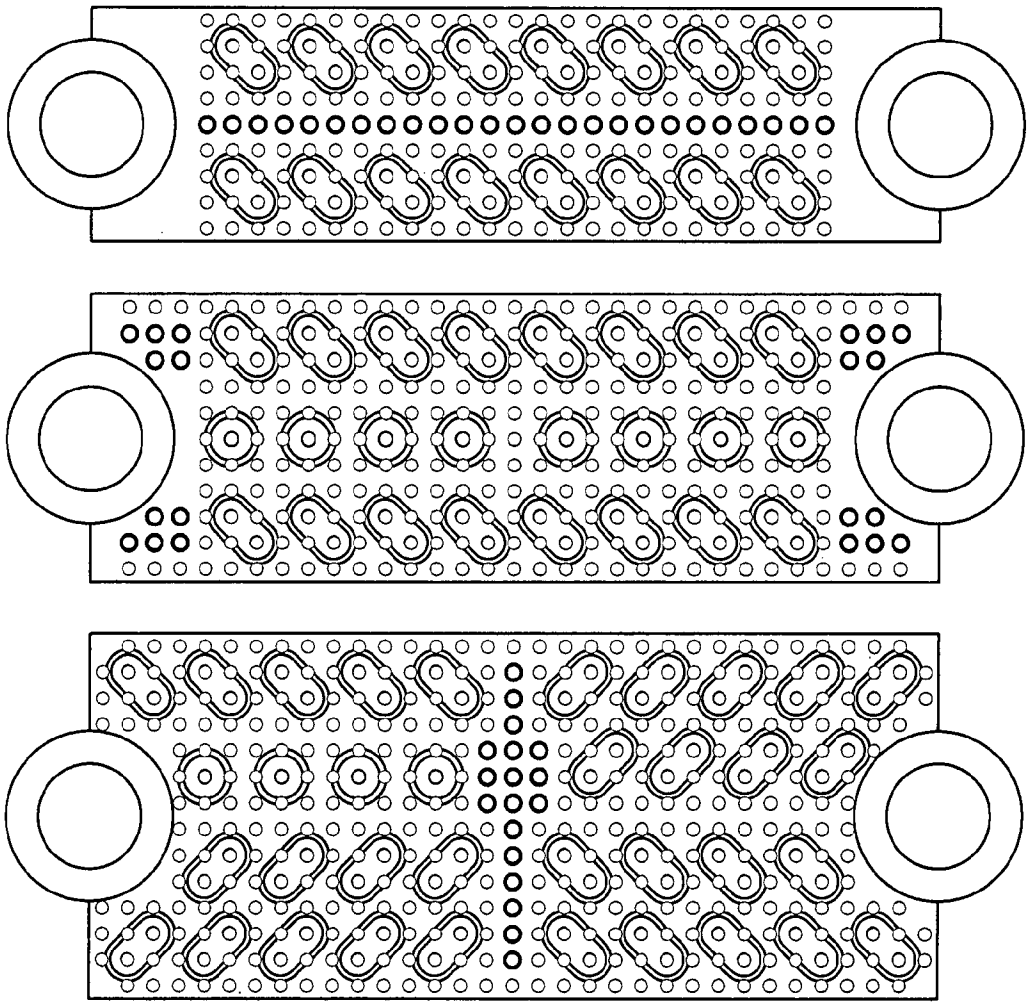
Figure 21:
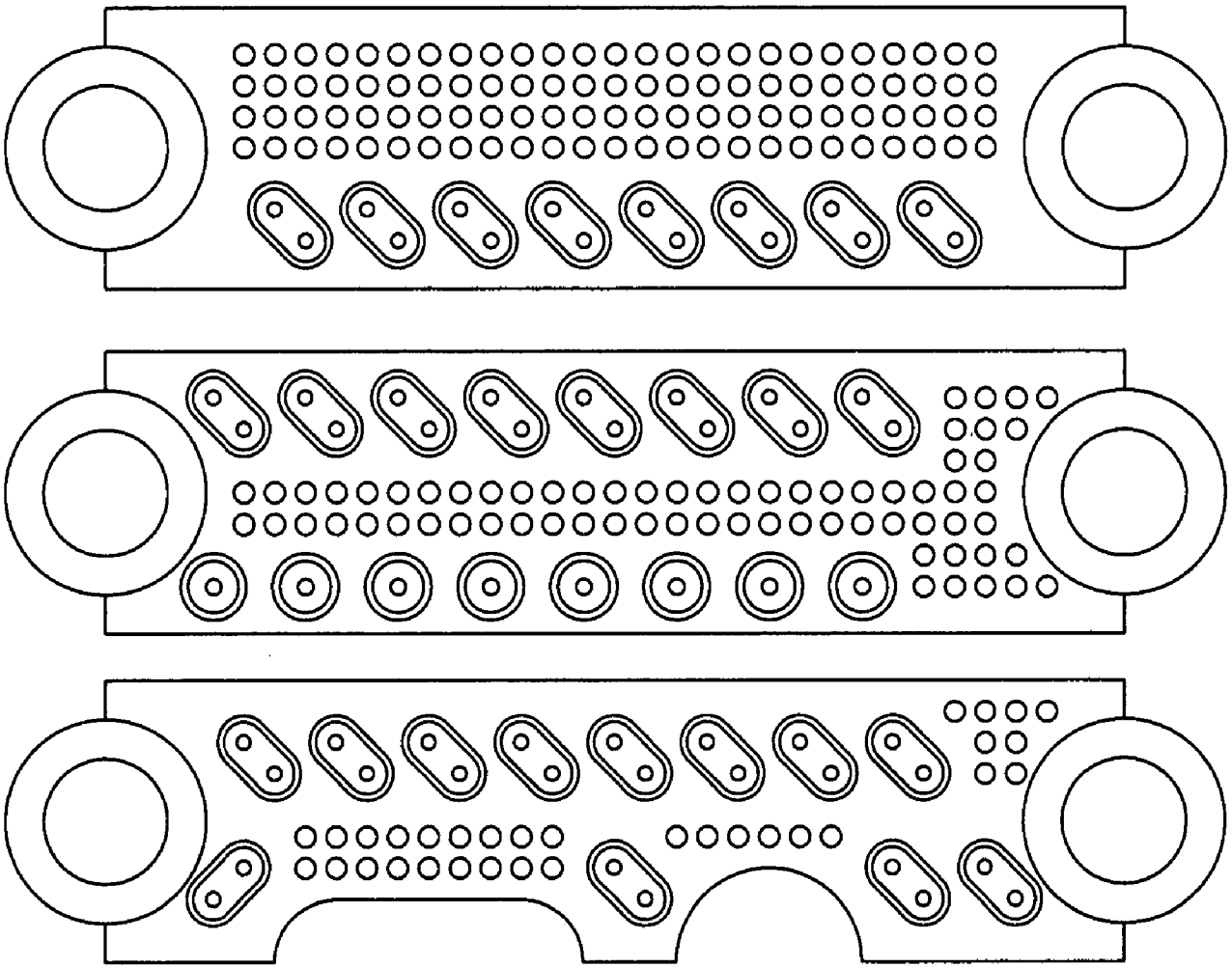
FIG. 21 is a top view of three connector slices disposed adjacently, a first connector slice having four rows of single conductor through-holes, and one row of twinax-style through-holes; a second connector slice having one row of twinax-style through-holes, two rows of single conductor through-holes plus additional single conductor through-holes disposed at one end of the second connector slice, and one row of coax-style through-holes; and a third connector slice having both twinax-style and single conductor through-holes disposed therein, along with cut-outs that allow the third connector slice to fit close to components such as integrated circuits, or other features on, for example, printed circuit boards.
Figure 22:
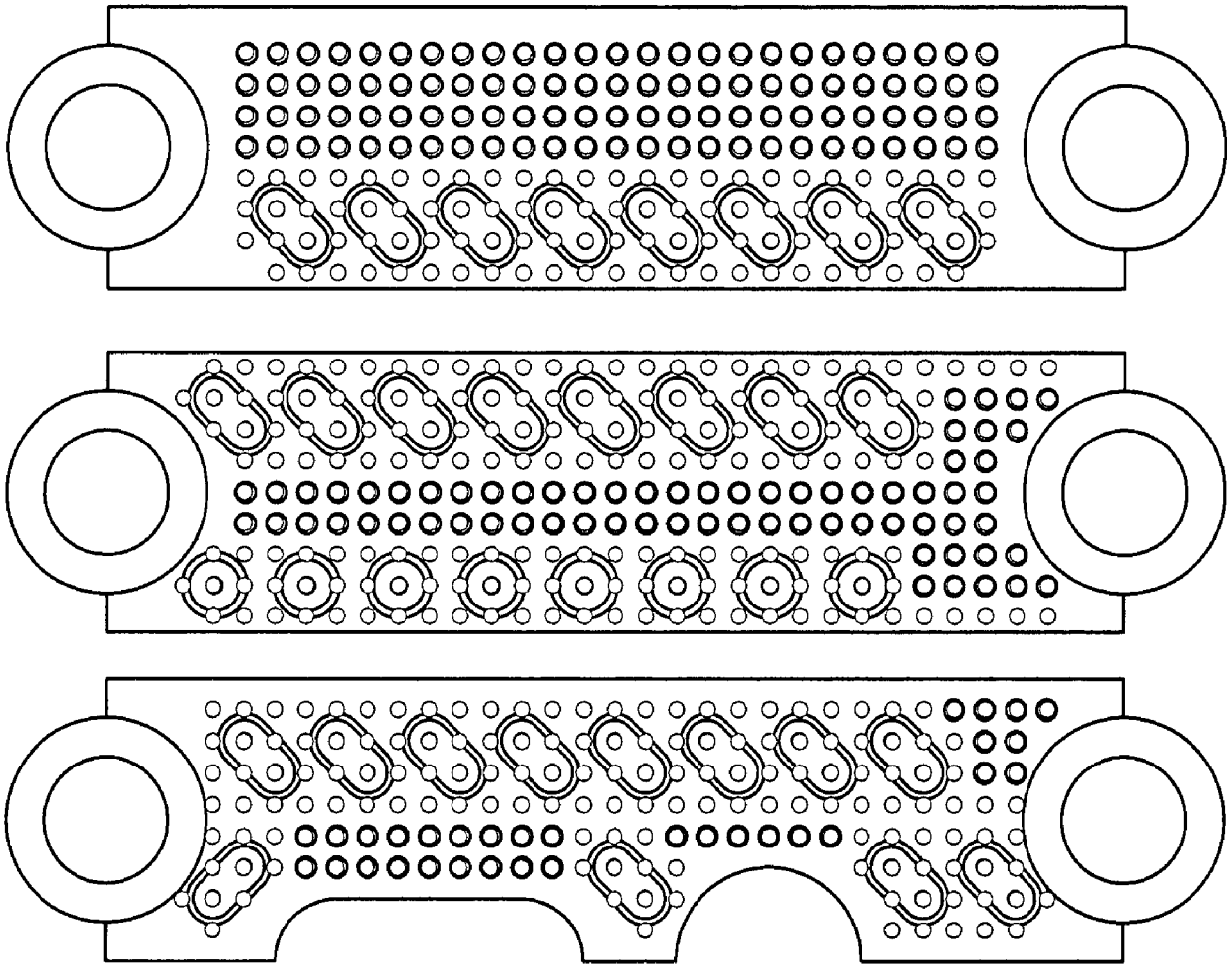
FIG. 22 illustrates how the conductors disposed in the through-holes of the connector slices of FIG. 21 form connections to a sheet of conductive bumps.

The connector is formed by stacking slices with the through-holes of each slice aligned so as to form a cavity through the connector body, through which a. conductor is disposed. With respect to retention of the conductor (e.g., bare wire, coax, twinax,) within a cavity of the connector formed from a stack of slices, any suitable means can be used in accordance with the present invention. In some embodiments, cavity interference features are used to take up the slack (FIG. 9). In some embodiments an adhesive may be used to facilitate retention of the conductor within the connector. In alternative embodiments a deformed conductor body may be used (FIG. 10). That is, a slight bend of the conductor, or bumps on the conductor, or, particularly in the case of a twinax, a slight twist applied to the conductor. Alternatively, a "tight sheet" (rigid or flex) may inserted into the cavity so as to increase the force holding the conductor in place (FIG. 11).

The conductors are typically cut to size so that they are flush, or co-planar, with either end of the connector. However, it is contemplated that these conductors may alternatively extend slightly above, or be recessed slightly below, the surfaces of either end of the connectors.

In alternative arrangements the slices have an electrically conductive coating disposed on the surfaces of the through-holes. In this way, the slices themselves may form the ground shield of a coax or twinax. In such embodiments, only the center conductors surrounded by a dielectric need to be disposed within the cavities formed by the through-holes of the stacked slices.

The slices may be formed such that an array of through-holes are formed therein. In typical embodiments, the slice may be generally rectangular and have an array sized N×M of through-holes, where N and M are integers. Typically the through-holes are uniformly spaced apart in such an array of through-holes, however, an arbitrary spacing of the through-holes in the slices is contemplated to be within the scope of the present invention.

In various illustrative alternative embodiments, shown in FIGS. 15–22, a slice may have a combination of through-holes having varied dimensions. For example, a slice may have through-holes for receiving one or more coax and one or more twinax. In a further example, there may be through-holes for receiving a variety of coax of sizes, and/or a variety of twinax sizes. Such a variety of through-holes may be arranged in the slice in an arbitrary manner.

As noted above, the present invention allows for slices having arbitrary arrangements of through-hole sizing and spacing, however, in typical embodiments the dimensions and spacing of the array of through-holes is coordinated with the design, or layout, of an intended touchdown, or contact area. For example, since a coax actually brings two conductors (the signal-carrying center conductor and the ground shield) through the connector, each of those two conductors must make contact with a respectively corresponding signal node and ground node. To achieve these contacts, the conductors present at either end of the connector should be physically arranged such that all the conductors of the array may be aligned and brought into contact with their intended connection points. Although coax was used to describe this situation, it will be appreciated that bare wire, twinax, or any other form of conductor disposed in the through-holes of the connector has similar requirements for making contact with the intended connection points.

In various embodiments, the conductors at either end of the connector may make electrical contact through a sheet of metal particle interconnect (MPI), a sheet of anisotropic conductor, through solder bumps disposed on a board, or any other suitable means.

Various embodiments of the present invention include post holes in the slices to receive posts or similar mechanical structures. Such posts may provide for alignment of the slices in a stack; may provide a means for attaching a pressure plate at either or both ends of the connector; or may provide a means for attaching a connector to a circuit board. Such post holes are typically circular in form, and fully surrounded by the insulating material of the slice. The post holes are not required to be circular.

In alternative embodiments, the post holes are not fully surrounded by the insulating material of the slices. In such an arrangement, the slice is typically formed so as to have one half of a post hole on either of its distal ends (i.e., the narrow ends of the rectangle). In this way, a planar array of slices may be combined to form a connector of arbitrary size. Where two slices abut at their narrow ends, the half post holes now form a single full post hole. It will be appreciated that this is an illustrative example, and that the present invention is not limited to placement of post holes on the narrow ends of slices. Similarly, the invention is not limited half post holes of each side of a slice, but rather any portion that is suitable for repeatedly abutting and combining the slices into a planar array may be used. Forming a planar array of slices is sometimes referred to as "ganging" the slices so as to form a connector of an arbitrary size. In such an arrangement, the ganged slices typically have the same thickness, however, having the same thickness is not a requirement of the present invention. It is noted that the slices that are ganged together do not each have to have the same arrangement of through-holes.

A family of connectors offering excellent electrical performance, and low cost of manufacturing, for right angle connections are disclosed and illustrated in FIGS. 25–37. In conventional systems that have adapter cards, or daughter boards, that are perpendicularly oriented to another circuit board, and wherein coax or twinax is used to connect various components therebetween, the cables are equipped at either end with conventional connectors, and are bent through a radius of curvature so as to attach to each board. A right angle connector, in accordance with the present invention, includes a structure having a base portion and an upright portion that is perpendicular to the base portion (this structure may be referred to as a right angle connector frame). Both the upright portion and the base portion are formed of electrically insulating material, and have through-holes adapted to receive conductors, such as, but not limited to, coax and twinax. In an illustrative example, the through-holes are adapted to receive twinax passing through at a 45 degree angle. In this way, the twinax passing through the connector is not bent, but rather is straight. Additionally, because the right angle connector may hold rigid twinax in place, those twinax are held in a fixed spaced apart relation, which means the problem of the electrically shorting one more twinax to each other is avoided. Therefore, the twinax used does not require an outer insulating jacket, thereby affording a more compact design. Such a right angle connector may be adapted to abut a perpendicular board, or may be formed so as to integrate mechanical support for the perpendicular board as well as to provide a plurality of straight conductors disposed on a 45 degree angle. It is noted that either end of the conductors which are supported by the right angle connector are typically cut to be flush with the connector, which means that the cut is at an angle with respect to the straight conductor. This actually provides more surface area for making contact with the conductors.

Figure 38:
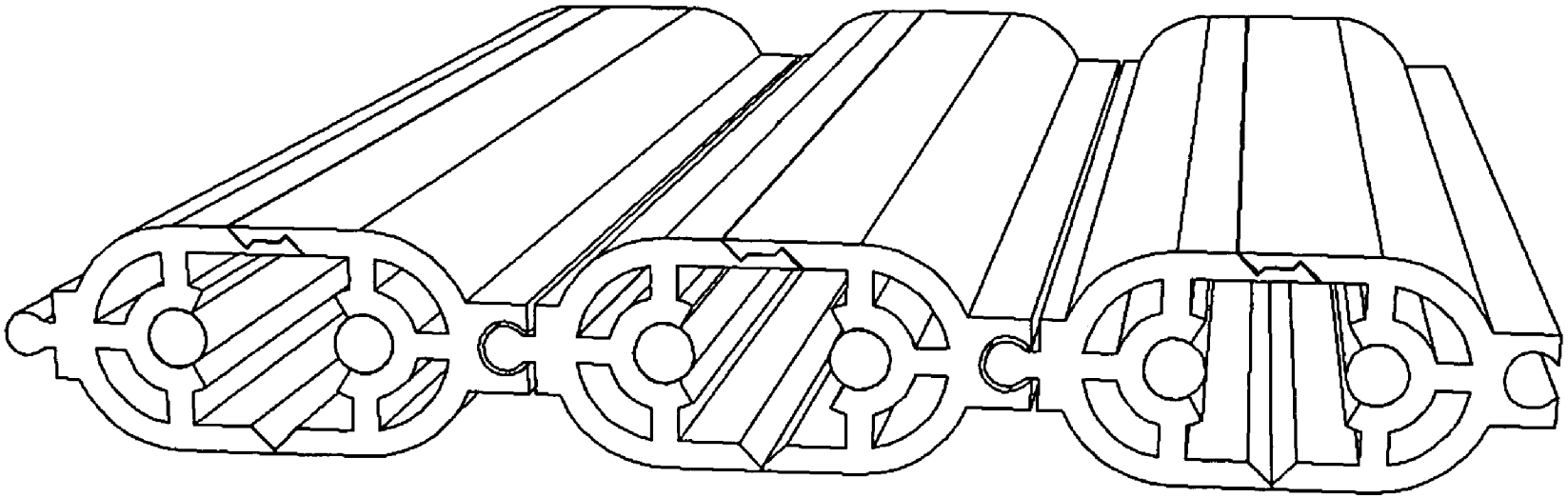
FIG. 38 is a lateral internal view of a low-cost, electrically insulating, plastic housing, adapted to support two spaced apart conductors therein.
Figure 39:
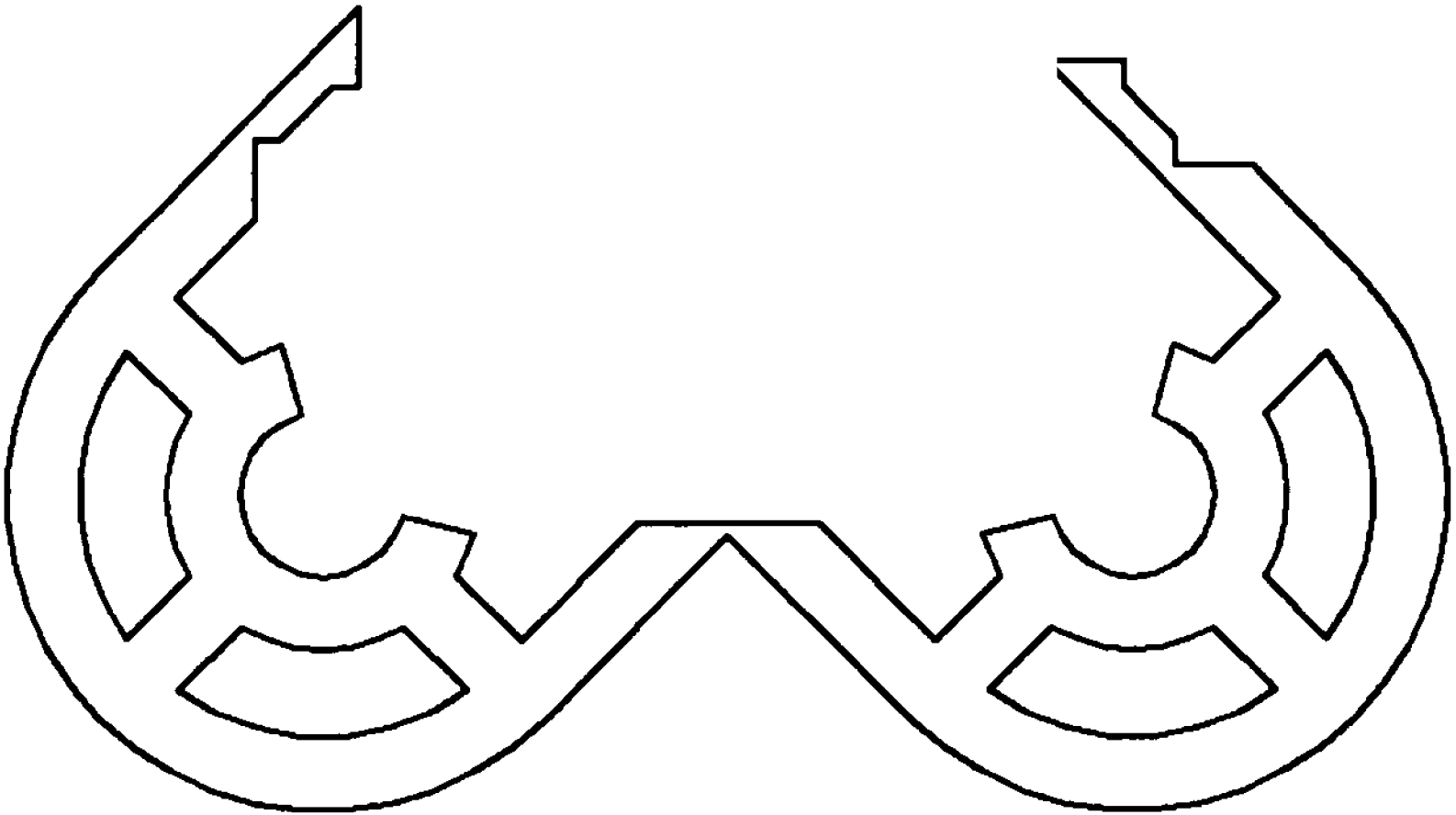
FIG. 39 is a head-on view of a low-cost, electrically insulating, plastic housing, adapted to support two spaced apart conductors therein.
Figure 40:
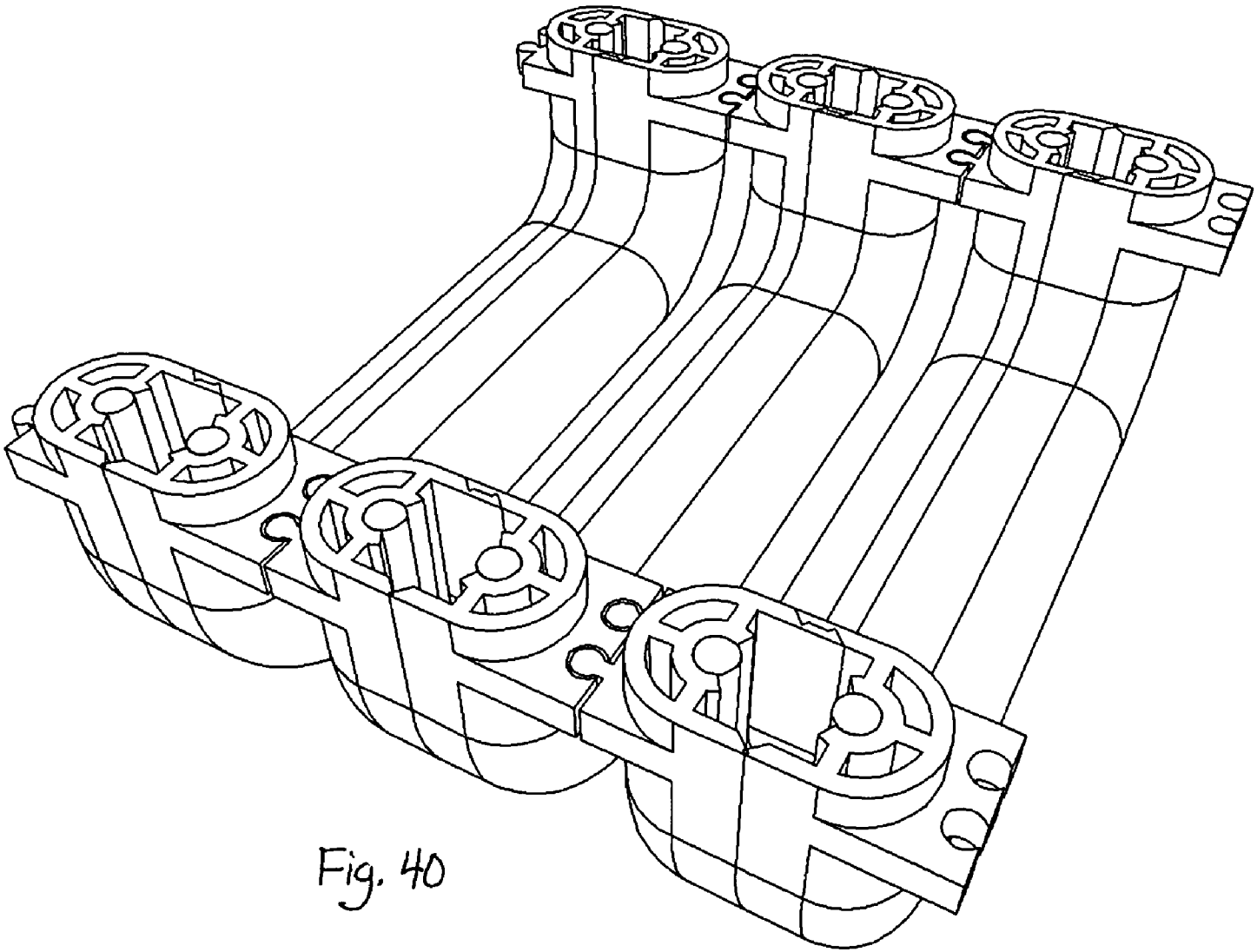
FIG. 40 is a cross-sectional view low-cost, electrically insulating, plastic housing, adapted to support two spaced apart conductors therein, wherein the plastic housing also includes a bend.

Structures for forming a low-cost twinax conductor are disclosed and illustrated in FIGS. 38–40. Conventional twinax includes two conductors separated and surrounded by a dielectric material, a ground shield surrounding the outer surface of the dielectric material, and an insulator, or insulating jacket, surrounding the outer surface of the ground shield. A twinax jacket, in accordance with the present invention, includes a low-cost plastic form that provides two structures supported by and attached to an outer insulating layer of the twinax jacket. Each of the two structures is adapted to receive a conductor such as a wire. Prior to inserting the conductors into the structures, the twinax jacket is open, either in two halves, or split open along a side opposite of a hinging, of flexible region. The wires typically snap into the structures. Subsequent to inserting the conductors, the twinax jacket is closed, that is, the two conductors are suspended inside the insulating jacket. Air is typically the dielectric material throughout the inner space of the twinax jacket, except for the structures that support, or suspend, the conductors within the twinax jacket. In some embodiments, the twinax jacket further includes tongue and groove style connection means so that a plurality of twinax jackets may be snapped together.

CONCLUSION

Various embodiments of the present invention include methods and apparatus for providing at least electrical continuity between a source and a destination of an electrical signal.

Embodiments of the present invention may find application in electronic devices and systems that use high frequency signals, such that transmission line effects are a design consideration.

Connector assemblies may be constructed in accordance with the present invention that are suitable for use with coax conductors. Such connector assemblies may be produced in accordance with the present invention for low costs as compared to conventional coax connector assemblies.

Connector assemblies may be constructed in accordance with the present invention which are suitable for use with twinax conductors. Such connector assemblies may be produced in accordance with the present invention for low costs as compared to conventional twinax connector assemblies.

Connector assemblies, such as the mezzanine connectors described herein, may be constructed from connector slices that combine through-holes for twinax cable segments, coax cable segments, and single conductors, and which offer planar connection interfaces to each of such conductors and, if appropriate, their ground shields. In another aspect of the present invention, the mezzanine connectors may be constructed such that conductive sheets are disposed between selected ones of the connector slices so as to form a common ground (or other node); and electrical contact between such conductive sheets and various conductors disposed in the connector slice through-holes may be selectively made by providing interference fits for desired connections and larger cut-outs in the conductive sheet for those locations where an electrical connection is not desired.

Twinax conductors in accordance with the present invention provide for low cost manufacturing and excellent high frequency performance.

An advantage of some embodiments of the present invention includes reduced impedance mismatches as compared to conventional connectors.

Another advantage of some embodiments of the present invention includes reduced cost of manufacturing as compared to conventional connectors.

It is to be understood that the present invention is not limited to the embodiments described above, but encompasses any and all embodiments within the scope of the subjoined claims and their equivalents.

What is claimed is:

1. A method of assembling a connector, comprising:

providing a plurality of connector slices, each connector slice comprising an electrically insulating body of a first thickness, the electrically insulating body having first and second major surfaces, and further having a plurality of through-holes providing openings between the first and second major surfaces;

stacking the plurality of connector slices, one atop another, in alignment such that major surfaces are facing one another and each through-hole of each connector slice is coaxially aligned with the corresponding through-holes of the other connector slices, and such that the stack so formed has a first predetermined height;

adhering at least one pair of the plurality of stacked connector slices to each other; and disposing a conductor that is surrounded by a dielectric layer into at least one of the plurality of through-holes;

wherein adhering comprises one of the group consisting of disposing a low viscosity glue between the at least one pair of the plurality of stacked connector slices, and disposing an adhesive sheet between the at least one pair of the plurality of stacked connector slices.

2. The method of claim 1, wherein the conductor surrounded by the dielectric layer further includes a conductive shield surrounding the dielectric layer.

3. The method of claim 2, wherein the conductive shield is surrounded by an insulating layer.

4. The method of claim 1, further comprising, disposing a twinaxial cable segment into at least one of the through-holes.

5. A method of assembling a connector, comprising:

providing a plurality of connector slices, each connector slice comprising an electrically insulating body of a first thickness, the electrically insulating body having first and second major surfaces, and further having a plurality of through-holes providing openings between the first and second major surfaces;

stacking the plurality of connector slices, one atop another, in alignment such that major surfaces are facing one another and each through-hole of each connector slice is coaxially aligned with the corresponding through-holes of the other connector slices, and such that the stack so formed has a first predetermined height; and disposing a conductor that is surrounded by a dielectric layer into at least one of the plurality of through-holes;

wherein each of the through-holes are adapted to receive a conductor; and further comprising disposing a tight-sheet between at least one pair of the stacked connector slices, the tight-sheet having through-holes coaxially aligned with the through-holes of the stacked connector slices.

6. The method of claim 5, wherein the tight-sheet comprises a flex material.

7. The method of claim 5, wherein the tight-sheet comprises a sheet of rigid material, the through-holes of the rigid material having an inner circumference that is less than an inner circumference of the through-holes of the stacked connector slices.

8. The method of claim 5, wherein the conductor surrounded by the dielectric layer further includes a conductive shield surrounding the dielectric layer.

9. The method of claim 8, wherein the conductive shield is surrounded by an insulating layer.

10. The method of claim 5, further comprising, disposing a twinaxial cable segment into at least one of the through-holes.

11. A method of assembling a connector, comprising:

providing a plurality of connector slices, each connector slice comprising an electrically insulating body of a first thickness, the electrically insulating body having first and second major surfaces, and further having a plurality of through-holes providing openings between the first and second major surfaces; and stacking the plurality of connector slices, one atop another, in alignment such that major surfaces are facing one another and each through-hole of each connector slice is coaxially aligned with the corresponding through-holes of the other connector slices, and such that the stack so formed has a first predetermined height;

wherein each of the through-holes are adapted to receive a conductor; and further comprising providing an electrically conductive coating in at least a portion of the through-holes of the plurality of connector slices; and disposing a conductive sheet between a pair of the plurality of stacked connector slices.

12. The method of claim 11, further comprising inserting a conductor with a dielectric coating into a conductively coated through-hole.

* * * * *